United States Patent [19]

Shanto et al.

[11] 4,111,213

[45] Sep. 5, 1978

[54] SMOKING PIPE

[76] Inventors: Albert J. Shanto, 114 State St., Brockport, N.Y. 14420; Bruce V. Bevins, 5708 Wautoma Beach Rd. W., Hilton, N.Y. 14468

[21] Appl. No.: 743,637

[22] Filed: Nov. 22, 1976

[51] Int. Cl.[2] ..... A24F 1/14; A24F 1/30

[52] U.S. Cl. ..... 131/173; 131/210

[58] Field of Search ..... 131/173, 200, 195, 210

[56] References Cited

U.S. PATENT DOCUMENTS

| | | | |
|---|---|---|---|
| 933,360 | 9/1909 | Carabias | 131/173 |
| 3,256,890 | 6/1966 | Jany | 131/173 |
| 3,863,646 | 2/1975 | Kahler | 131/173 |
| 3,872,872 | 3/1975 | Kahler | 131/173 |
| 4,031,906 | 6/1977 | Knapp | 131/173 |

*Primary Examiner*—Stephen C. Pellegrino
*Attorney, Agent, or Firm*—Stonebraker, Shepard & Stephens

[57] ABSTRACT

A smoking pipe includes a base, a cylindrical standpipe extending upward from the base, and a smoke inlet pipe arranged concentrically within the standpipe and extending from near the base up to a little above an intermediate water level. Baffle plates are disposed around the inlet pipe at successive levels below the water level and extend radially between the inlet pipe and the standpipe to form a labyrinthine passage for smoke. The standpipe wall has a vent hole and an inlet hole above the water level, and a bowl support pipe having a general S shape is removably but snugly fitted through the inlet hole to releasably fit into the upper end of the inlet pipe and to support a bowl outside the standpipe.

4 Claims, 3 Drawing Figures

SMOKING PIPE

BACKGROUND OF THE INVENTION

Water pipes have long been popular for smoking various dried plants, but they involve problems in effectiveness, expense, assembly costs, and convenience of cleaning. The invention involves recognition of a way of substantially improving on a type of water pipe commonly called a "bong", and the invention aims at a more effective water pipe that is better able to cool the smoke, is economical to make and assemble, and is easily taken apart for convenience of cleaning.

SUMMARY OF THE INVENTION

The inventive smoking pipe includes a base and a standpipe that is generally cylindrical and secured to the base to extend upward and contain water up to an intermediate level. A smoke inlet pipe is arranged generally concentrically within the standpipe and extends from the region of the base up to above the intermediate level. Several baffle plates are disposed around the inlet pipe at successive levels below the intermediate level to extend radially from the inlet pipe outward to the wall of the standpipe, and the baffle plates form a labyrinthine passage for smoke. The standpipe wall has an inlet hole above the intermediate level, and a bowl support pipe having a general S shape removably extends snugly through the inlet hole. The inner end of the bowl support pipe is releasably fitted to the upper end of the inlet pipe, and a bowl is mounted in the outer end of the bowl support pipe outside the standpipe, which also has a vent hole above the intermediate level. The standpipe, inlet pipe, baffle plates, and bowl support pipe are all preferably formed of substantially transparent resin material, and the baffle plates preferably hold the inlet pipe in the standpipe by a friction fit. The bowl support pipe is easily removed for cleaning and to allow cleaning of the inlet pipe.

DRAWINGS

DETAILED DESCRIPTION

Figure 1:
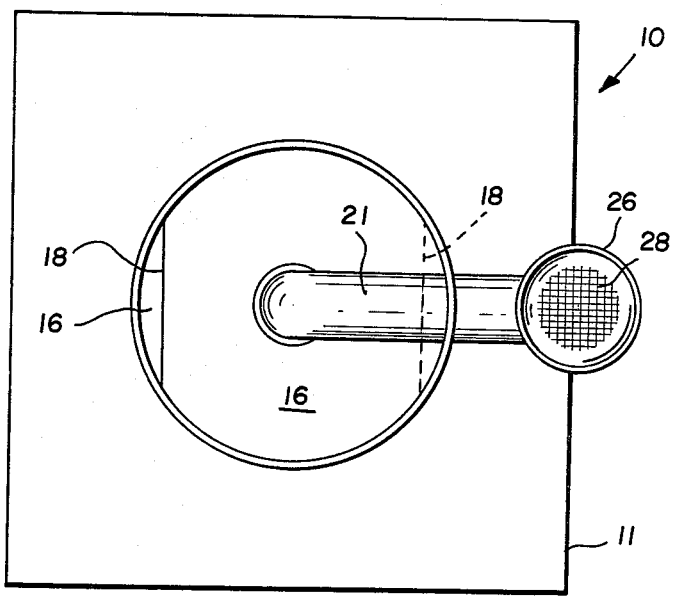
FIG. 1 is a plan view of a preferred embodiment of the inventive smoking pipe.
Figure 2:
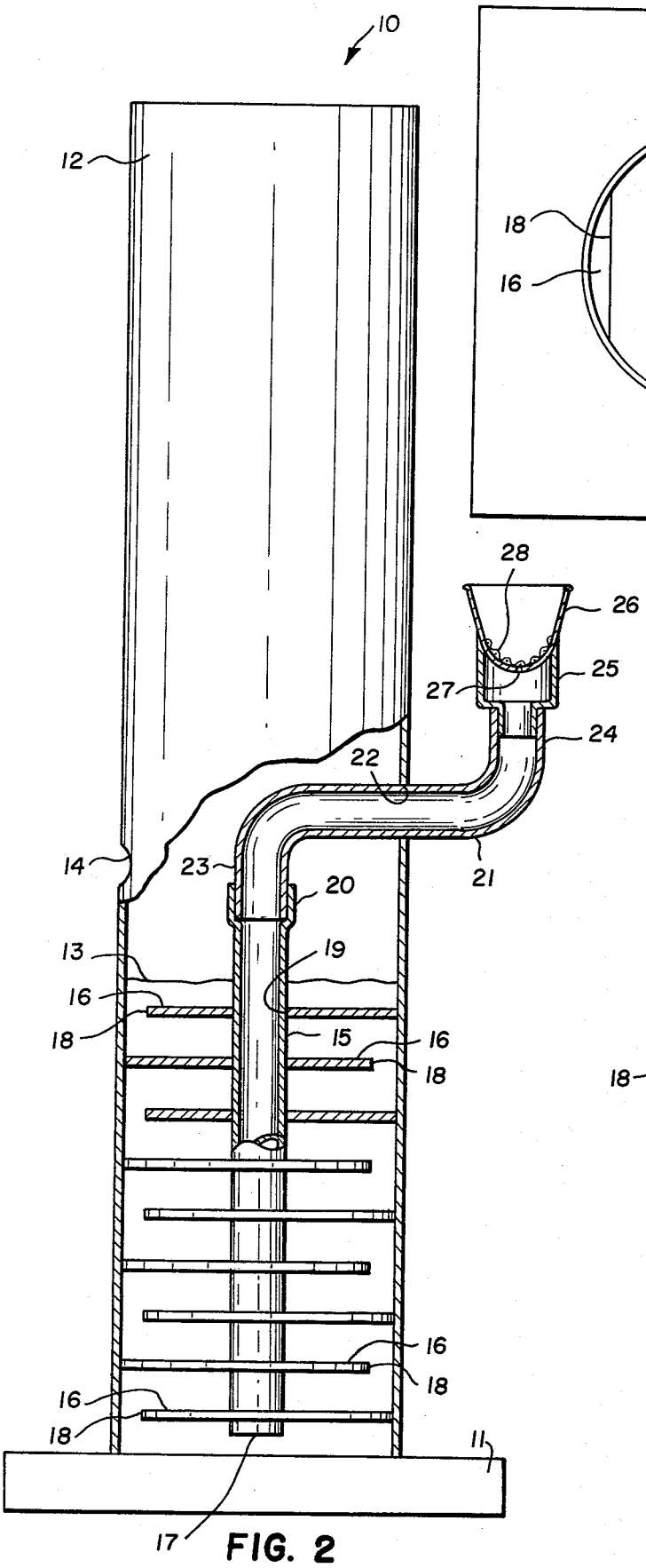
FIG. 2 is a partially cut-away elevational view of the smoking pipe of FIG. 1.

Smoking pipe 10 shown in the drawings is one preferred form of the invention improving on a form of water pipe commonly known as a "bong". It includes a base 11 having any convenient shape and preferably large enough and flat enough to support the pipe upright on a flat surface. A standpipe 12 having a generally cylindrical wall is secured to base 11 to extend upward from base 11 and contain water up to an intermediate level 13. The depth of water can be varied considerably within standpipe 12, and a sufficient depth of water is preferred for substantially cooling smoke. Standpipe 12 and base 11 are both preferably formed of resin material with a watertight joint between pipe 12 and base 11, and standpipe 12 also preferably has a vent hole 14 located in any convenient place above water level 13 for venting the pipe as smoke is drawn out from above water level 13.

A smoke inlet pipe 15, preferably formed of resin tubing, is arranged concentrically within standpipe 12 to extend upward from near base 11 to a little above water line 13 at an intermediate level in standpipe 12.

A series of baffle plates 16 are arranged on inlet pipe 15 in a succession from the lower end 17 of inlet pipe 15 upward to preferably just below water level 13. Baffle plates 16 are preferably formed of resin material and preferably have a D shape or a flat or chord side 18 and extend radially outward from inlet pipe 15 to the wall of standpipe 12. The flat or chord sides 18 of baffle plates 16 provide openings that preferably alternate at 180° opposite relations as illustrated to form a labyrinthine smoke passage from the bottom of inlet pipe 15 to the uppermost baffle plate 16. This makes the smoke follow a long zigzag path upward around baffle plates 16 to reach the space above water level 13, and this cools the smoke more effectively than merely letting it rise directly upward from the bottom 17 of inlet pipe 15. The labyrinthine smoke passage formed by baffle plates 16 also makes pipe 10 more interesting by enhancing the sights and sounds produced when the pipe operates.

Figure 3:
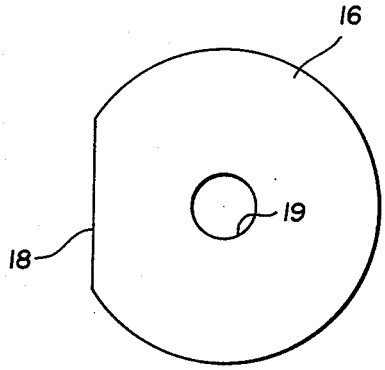
FIG. 3 is a plan view of a preferred form of baffle plate for the pipe of FIGS. 1 and 2.

One preferred way of making baffle plates 16 is to die cut them from a sheet of resin material to have the shape shown in FIG. 3 with a chord side 18 and a central hole 19. Baffle plates 16 are then slid successively over the end 17 of inlet pipe 15 and evenly spaced along the length of inlet pipe 15 in the preferred opposite orientations of chord sides 18. A drop or two of a suitable solvent applied to the junction between baffle plates 16 and inlet pipe 15 forms solvent bonds securing all the baffle plates 16 to inlet pipe 15. The subassembly of inlet pipe 15 and baffle plates 16 is then positioned within standpipe 12 where it is preferably held in place by a friction fit between baffle plates 16 and the inside of the wall of standpipe 12. This is easily done by forcing the inlet pipe and baffle plate assembly downward into standpipe 12 after it has been secured to base 11.

Lower end 17 of inlet pipe 15 is preferably spaced a little above base 11, or alternatively, has side openings or a spacer device to insure that the bottom of inlet pipe 15 remains open over base 11. The upper end of inlet pipe 15 preferably has an enlarged socket 20 as illustrated. As an alternative to the suggested subassembly of inlet pipe 15 and baffle plates 16, a single injection-molded component can be formed to provide both inlet pipe 15 and baffle plates 16 as an integral part to be fitted within standpipe 12.

A bowl support pipe 21, also preferably formed of transparent resin tubing, has a general S shape as illustrated and fits snugly and removably through an inlet hole 22 in the wall of standpipe 12. The inner end 23 of bowl support pipe 21 fits releasably into socket 20 at the upper end of inlet pipe 15, and the outer end 24 of bowl support pipe 21 has a bushing 25 supporting a bowl 26, which is conveniently formed as a conventional metal thimble bored to form a bottom opening 27. Bowl 26 is then conveniently removable from bushing 25 for cleaning purposes, and also contains a replaceable screen 28 over opening 27.

Bowl support pipe 21 can be sized for a snug, releasable fit within the inside or over the outside of inlet pipe 15 to eliminate the need for socket 20, and a variety of bushings or other supports can be used to hold different bowls on outer end 24 of bowl support pipe 21. Except for bowl 26, screen 28, and bowl support bushing 25, all the other parts of pipe 10 are preferably made of resin material, and the preferred resin is preferably substantially transparent or lightly tinted both for ease of cleaning and also to facilitate viewing the operation of the pipe. Bowl support pipe 21 is easily disconnected from its fit with the upper end of inlet pipe 15 and can be removed through inlet hole 22 for cleaning. This also allows a cleaning tool to be worked vertically down through inlet pipe 15 for cleaning.

It is even possible to remove the subassembly of inlet pipe 15 and baffle plates 16 for cleaning, if necessary, providing that baffle plates 16 are not permanently bonded to standpipe 12.

In operation, after pipe 10 is assembled as illustrated, smoke is drawn from bowl 26 through bowl support pipe 21, down through inlet pipe 15, and up through the zigzag labyrinthine path around baffles 16 to be cooled by the water on its way upward to the space above water level 13. When sufficient smoke has collected above water level 13, the user removes a finger from vent hole 14 and withdraws the smoke from the upper end of standpipe 12.

Persons skilled in the art will appreciate the various materials that are usable in constructing pipe 10, and the different configurations and assembly methods that are possible in practicing the invention.

What is claimed is:

1. A smoking pipe having a base, a normally upright standpipe having a generally cylindrical wall secured to said base of extend upward from said base for containing liquid up to an intermediate level in said standpipe, said standpipe wall having an inlet hole above said intermediate level, a bowl support pipe removably extending snugly through said inlet hole, means for mounting a bowl on an outer end of said bowl support pipe outside said standpipe, and said standpipe wall having a vent hole above said intermediate level, said pipe comprising:

a. a straight smoke inlet pipe having a diameter and length both substantially less than said standpipe, said smoke inlet pipe being arranged generally concentrically with said standpipe within said standpipe to extend from a bottom region of said standpipe near said base up to a region above said intermediate level;

b. a plurality of baffle plates disposed to fit around and encircle said inlet pipe at successive levels below said intermediate level, said baffle plates being generally parallel with each other and extending radially from said inlet pipe outward to said wall of said standpipe, and said baffle plates being arranged for supporting said inlet pipe concentrically within said standpipe and for forming a labyrinthine passage for smoke; and c. an upper end of said inlet pipe and an inner end of said bowl support pipe being configured relative to each other to provide a manually releasible fit between said upper end of said inlet pipe and said inner end of said bowl support pipe to allow for manually removing said bowl support pipe from said inlet pipe and said standpipe.

2. The pipe of claim 1 wherein said baffle plates are generally D-shaped with chord sides disposed at alternate orientations angled approximately 180° apart.

3. The pipe of claim 1 wherein said baffle plates are arranged for holding said inlet pipe in said standpipe by a friction fit with the inside of said standpipe wall.

4. The pipe of claim 1 wherein said baffle plates are generally D-shaped with chord sides disposed at alternate orientations angled approximately 180° apart.

* * * * *